US009046286B2

(12) United States Patent
Hawkins et al.

(10) Patent No.: US 9,046,286 B2
(45) Date of Patent: Jun. 2, 2015

(54) HEAT PUMP POOL HEATER START-UP PRESSURE SPIKE ELIMINATOR

(75) Inventors: Timothy B. Hawkins, Fort Smith, AR (US); Paul D. McKim, Fort Smith, AR (US)

(73) Assignee: RHEEM MANUFACTURING COMPANY, Atlanta, GA (US)

( * ) Notice: Subject to any disclaimer, the term of this patent is extended or adjusted under 35 U.S.C. 154(b) by 519 days.

(21) Appl. No.: 13/401,070

(22) Filed: Feb. 21, 2012

(65) Prior Publication Data

US 2012/0247142 A1 Oct. 4, 2012

Related U.S. Application Data

(60) Provisional application No. 61/470,175, filed on Mar. 31, 2011.

(51) Int. Cl.

| | |
|---|---|
| ***F25B 49/02*** | (2006.01) |
| ***F25B 41/04*** | (2006.01) |
| ***F25B 30/02*** | (2006.01) |

(52) U.S. Cl.

CPC ..... *F25B 30/02* (2013.01); *F25B 2339/047* (2013.01); *F25B 2500/07* (2013.01); *F25B 2500/26* (2013.01)

(58) Field of Classification Search

CPC ..... F25B 49/025; F25B 49/022; F25B 49/02; F25B 2600/021; F25B 41/04; F25B 2400/075; F25B 1/10; F25B 31/008; F25B 2400/13; F25B 2309/061; F25B 9/008; F04B 27/1804

USPC ..... 62/228.4, 228.3, 228.1, 228.5, 197, 62/196.2, 196.1, 510, 512, 513, 90

See application file for complete search history.

(56) References Cited

U.S. PATENT DOCUMENTS

| | | | | |
|---|---|---|---|---|
| 4,423,603 | A * | 1/1984 | Oguni et al. | 62/324.1 |
| 5,136,855 | A | 8/1992 | Lenarduzzi | |
| 2002/0092318 | A1* | 7/2002 | Tipton et al. | 62/510 |
| 2005/0144977 | A1* | 7/2005 | Matsumoto et al. | 62/513 |
| 2008/0078204 | A1* | 4/2008 | Ignatiev | 62/512 |
| 2008/0127667 | A1 | 6/2008 | Buckley et al. | |
| 2008/0184727 | A1 | 8/2008 | Innes | |
| 2010/0326622 | A1* | 12/2010 | Maxwell | 165/45 |
| 2011/0030397 | A1* | 2/2011 | Taras et al. | 62/90 |
| 2011/0100035 | A1* | 5/2011 | Taras et al. | 62/90 |

* cited by examiner

*Primary Examiner* — Frantz Jules
*Assistant Examiner* — Meraj A Shaikh
(74) *Attorney, Agent, or Firm* — Haynes and Boone, LLP

(57) ABSTRACT

In a heat pump pool heater, undesirable compressor-created pressure spikes resulting from start-up of the heater after extended idle periods thereof are substantially eliminated by the incorporation in the heat pump refrigerant circuit of a specially designed pressure spike eliminator structure. The spike eliminator structure includes an enclosed hollow wall structure extending around a first refrigerant tubing portion disposed between the heat pump circuit compressor and condenser and forming a cavity around the first refrigerant tubing portion, and a transfer tube directly connected to a second refrigerant tubing portion disposed between the condenser and expansion valve and intercommunicating the interiors of the cavity and the second refrigerant tubing portion.

13 Claims, 1 Drawing Sheet

HEAT PUMP POOL HEATER START-UP PRESSURE SPIKE ELIMINATOR

CROSS-REFERENCE TO RELATED APPLICATION

This application claims the filing priority benefit of U.S. provisional patent application Ser. No. 61/470,175 filed on Mar. 31, 2011, such prior application being hereby incorporated by reference herein in its entirety.

BACKGROUND OF THE INVENTION

An operational problem that may occur in a heat pump type pool heater (utilizing either a dedicated "heat only" or reversible heating/cooling heat pump circuit) is the generation of high hydraulic pressure spikes occurring upon start-up of the heater after it has been idle (i.e., in the "off" mode) for several days. A sudden increase ("spike") in hydraulic pressure tends to exceed the setting of the over-pressure sensor of the heater which results in the automatic termination of the operation of the unit's compressor. If this pressure spike-created shutoff occurs three times, the control system locks out the compressor which requires the owner to manually reset the control or call a service technician to place the unit back in operation.

It is believed that this pressure spike problem is caused by too much refrigerant migrating to the relatively small volume water-to-refrigerant heat exchanger used on heat pump pool heaters that fills up the space inside the heat exchanger during the off cycle over an extended time. When the compressor starts, there is not enough gaseous refrigerant between the compressor and expansion device to absorb the sudden increase in pressure produced by the scroll compressor on unit start-up.

This issue is most prevalent on larger size heat pump pool heaters with large evaporator coils and high refrigerant charges relative to the water heater exchanger. Standard receivers help somewhat, but are not that effective and require the addition of costly refrigerant. Historically, the main way to eliminate the nuisance tripping of the pressure sensor is to simply reduce the refrigerant charge of the unit, thereby undesirably lowering the unit's water heating capacity.

As can be seen from the foregoing, a need exists for apparatus that eliminates or at least substantially diminishes this compressor start-up pressure spike problem in a heat pump pool heater or other type of heat pump-based liquid heater. It is to this need that the present invention is primarily directed.

DETAILED DESCRIPTION

Figure 1:
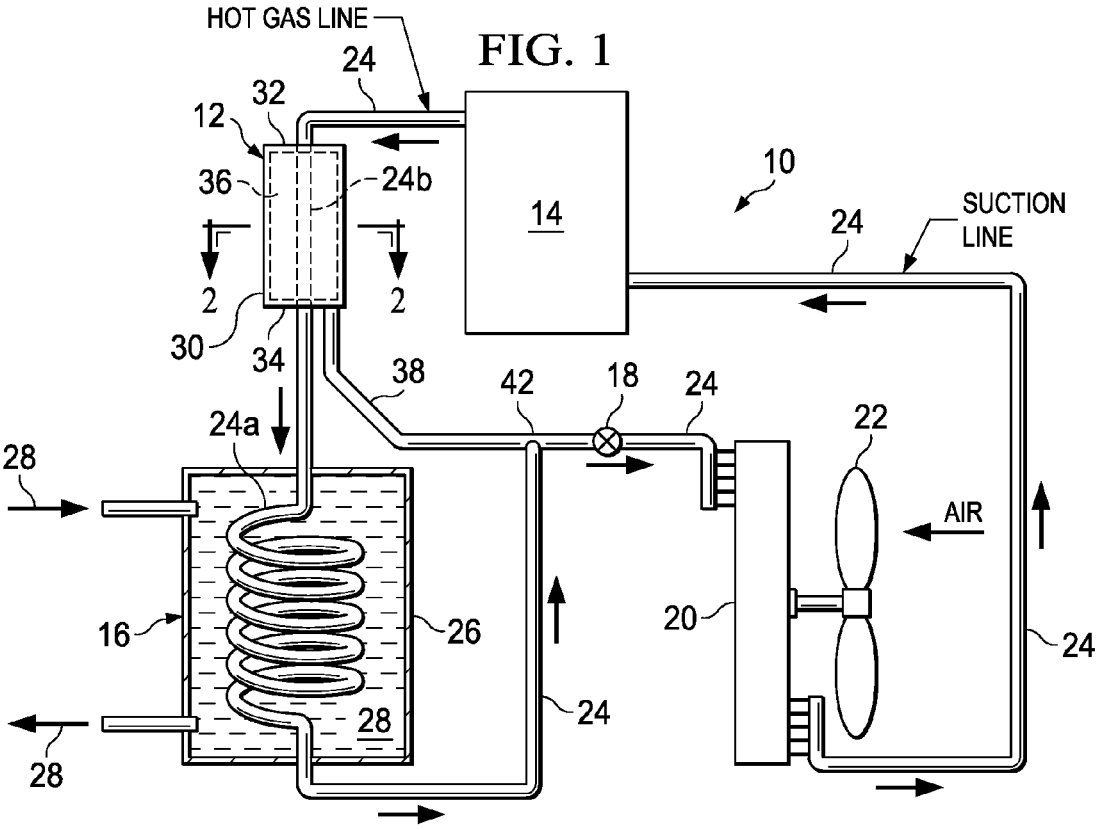
FIG. 1 is a schematic circuit diagram of the heat pump circuit having a specially designed pressure spike elimination apparatus operatively incorporated therein.
Figure 2:
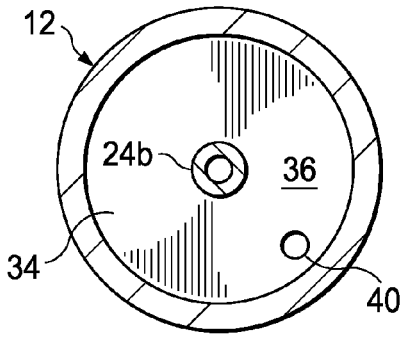
FIG. 2 is a cross-sectional view taken through a tubular body portion of the pressure spike elimination apparatus along line 2-2 of FIG. 1.

In a representatively illustrated embodiment thereof this invention provides specially designed pressure spike elimination apparatus in a heat pump pool heater to prevent undesirable pressure spikes at the compressor outlet upon system start-up after a substantial downtime period of the heat pump. The representative embodiment of the pressure spike-protected heat pump circuit is illustrated in the accompanying drawings in which:

As schematically depicted in FIGS. 1 and 2, this invention provides, representatively in a heat pump pool heater 10, specially designed pressure spike eliminator apparatus or structure 12 functioning as later described herein to eliminate undesirable compressor pressure spikes upon system start-up after a substantial downtime of the system. The pool heater 10 is illustratively a dedicated "heat only" heat pump, but could alternatively be a reversible heating/cooling heat pump if desired. Also, the heater 10 could, of course, be used to heat a liquid other than pool water.

The heat pump pool heater 10 illustratively comprises a compressor 14, a condenser 16, an expansion valve 18 and an evaporator coil 20 (with an associated fan 22) connected in series as shown by refrigerant tubing 24 through which, during operation of the heater 10, refrigerant flows in the indicated counterclockwise direction. Specifically, the refrigerant sequentially flows from the outlet of the compressor 14, through the condenser 16, through the expansion valve 18, through the evaporator coil 20, and back into the inlet of the compressor 14. As illustrated, a section of the tubing 24 forms a condenser coil 24*a* within a housing portion 26 of the condenser 16, the coil 24*a* being immersed in pool water 28 being appropriately pumped through the housing 26 to receive refrigerant heat from the coil 24*a*.

The pressure spike eliminator structure 12 includes a tubular outer body 30, with closed upper ends 32 and 34, through which a section 24*b* of the tubing 24 vertically passes, with the tubing 24 being suitably sealed to the body ends 32 and 34. As illustrated, the tubing section 24*b* extends through an annular cavity 36 disposed in the body 30 and circumscribing the tubing section 24*b*. Outer body 30 is disposed in the tubing 24 between the discharge of the compressor 14 and the inlet of the condenser 16. While the tubing section 24*b* is schematically depicted as being an integral portion of the overall tubing 24, it may alternatively be an integral portion of the spike eliminator 12 outer body and may be appropriately secured to facing ends of the tubing 24.

A connector or transfer tube 38 is directly connected at an outlet end thereof to a small inlet opening 40 in the lower end 34 of the outer body 30, and directly connected at an inlet end thereof to a tee portion 42 of the tubing 24 at a location thereon between the outlet of the condenser 16 and the expansion valve 18. Accordingly, the transfer tube 38 communicates the interior of the refrigerant tubing 24 (at the indicated tee location therein) with the cavity 36 in the outer body 30 of the spike eliminator. During operation of the heat pump 10, hot compressor discharge gas flowing through the tubing portion 24*b* evaporates any liquid refrigerant that may find its way into the body cavity 36. However, during off periods of the heat pump 10, the pressure spike eliminator structure 12 provides the refrigerant system with a "shock absorber" that prevents compressor overpressurization, and attendant unit shutdown, on re-starts of the heater 10 after extended shutdown periods.

As can be envisioned from the circuit diagram of FIG. 1, with refrigerant in a lower end portion of the spike eliminator body 30 (during an off period of the heater 10), a gas pocket would exist above any refrigerant that may have migrated into the body 30 which would rapidly be compressed by the refrigerant pressure created at the compressor outlet at system start-up. And, of course, pressure cushioning air within the body chamber 36 would also efficiently eliminate compressor start-up pressure spikes in instances that refrigerant did not migrate into the body 30 during a given system down period. Additionally, even if while the pool heater 10 is shut off refrigerant migrates into and substantially fills the body cavity 36, this reduces the amount of refrigerant in the overall tubing 24 to an extent such that undesirably high compressor start-up pressure spikes are also eliminated.

The pressure spike eliminator apparatus 12 is simple and inexpensive to install, in either the original fabrication of the illustrated refrigerant circuitry or in a retrofit installation, and is highly effective in eliminating the problems associated with system start-up pressure spikes.

What is claimed is:

1. Heat pump apparatus comprising:

a refrigerant circuit having a compressor, a condenser, an expansion valve and an evaporator operatively interconnected in refrigerant tubing in a manner such that during operation of said heat pump apparatus refrigerant in said refrigerant tubing sequentially flows outwardly from said compressor, through said condenser, through said expansion valve, through said evaporator and then back into said compressor, the condenser comprising a heat transfer portion of the tubing between the compressor and the expansion valve;

pressure spike eliminator apparatus for substantially eliminating an undesirable compressor pressure spike upon start-up of said heat pump apparatus after a shutdown period thereof, said pressure spike eliminator apparatus comprising:

an enclosed hollow wall structure extending around a first refrigerant tubing portion disposed between said compressor and said condenser and forming a cavity around said first refrigerant tubing portion, and a transfer tube directly connected to a second refrigerant tubing portion disposed between said condenser and said expansion valve and intercommunicating the interiors of said cavity and said second refrigerant tubing portion; and a housing portion housing at least a portion of the heat transfer portion tubing, the housing portion configured to allow a fluid to pass along an exterior of the heat transfer portion of the tubing.

2. The heat pump apparatus of claim 1 wherein:

said heat pump apparatus is a pool heater.

3. The heat pump apparatus of claim 1 wherein:

said heat pump is a dedicated heat-only type of heat pump.

4. The heat pump apparatus of claim 1 wherein:

said heat pump apparatus further comprises a tee operatively connected to said second refrigerant tubing portion, and said transfer tube is directly connected to said second refrigerant tubing portion via said tee.

5. The heat pump apparatus of claim 1 wherein said housing portion comprises a water inlet and a water outlet, and the heat transfer portion comprises a coiled portion of said refrigerant tubing extending through the interior of said housing portion.

6. A heat pump pool heater comprising:

a refrigerant circuit having a compressor, a condenser, an expansion valve and an evaporator operatively interconnected in refrigerant tubing in a manner such that during operation of said heat pump apparatus refrigerant in said refrigerant tubing sequentially flows outwardly from said compressor, through said condenser, through said expansion valve, through said evaporator and then back into said compressor, said condenser including a housing portion having a water inlet and a water outlet, and a coiled portion of said refrigerant tubing extending through the interior of said housing portion, the housing portion configured to allow a fluid to pass along an exterior of the coiled portion of the tubing;

a hollow wall structure defining a cavity extending around a first portion of said refrigerant tubing disposed between said compressor and said condenser; and a transfer tube having an inlet end directly coupled to a second portion of said refrigerant tubing disposed between said condenser and said expansion valve, and an outlet end connected to said hollow wall structure, said transfer tube communicating said cavity with the interior of said second portion of said refrigerant tubing and permitting refrigerant within said second portion of said refrigerant tubing to migrate into said cavity during off periods of said heat pump pool heater.

7. The heat pump pool heater of claim 6 wherein:

said heat pump pool heater is a dedicated heat-only heat pump.

8. The heat pump pool heater of claim 6 wherein:

said heat pump pool heater further comprises a tee operatively connected to said second refrigerant tubing portion, and said transfer tube is directly connected to said second refrigerant tubing portion via said tee.

9. For use in conjunction with heat pump apparatus comprising a refrigerant circuit having a compressor, a condenser, an expansion valve and an evaporator operatively interconnected in refrigerant tubing in a manner such that during operation of said heat pump apparatus refrigerant in said refrigerant tubing sequentially flows outwardly from said compressor, through said condenser, through said expansion valve, through said evaporator and then back into said compressor, said condenser including a housing portion having an inlet, an outlet, and a heat transfer portion of the tubing, a method of preventing an undesirably high compressor pressure spike upon start-up of said heat pump apparatus after a shutdown period thereof, said method comprising the steps of:

forming a refrigerant-receiving cavity externally around a first refrigerant tubing portion disposed between said compressor and said condenser;

forming a refrigerant transfer path, through which refrigerant may flow into said cavity from within a second refrigerant tubing portion during said shutdown period, by communicating an outlet end of a refrigerant transfer tube with said cavity and directly coupling an inlet end of said refrigerant transfer tube to said second refrigerant tubing portion; and passing a fluid from the inlet of the housing portion, along an exterior of the heat transfer portion of tubing, and to the outlet of the housing portion.

10. The method of claim 9 wherein:

said method further comprises the step of connecting a tee in said second refrigerant tubing portion, and said step of forming a refrigerant transfer path includes the step of connecting said inlet end of said refrigerant transfer tube to said tee.

11. The method of claim 9 wherein:

said refrigerant circuit is a dedicated heat-only heat pump circuit.

12. The method of claim 9 wherein:

said refrigerant circuit is a reversible heating/cooling heat pump circuit.

13. The method of claim 9 wherein:

said heat pump apparatus is a pool heater.

* * * * *